United States Patent [19]

Butler

[11] 4,335,170

[45] Jun. 15, 1982

[54] SIMULATED STAINED AND LEADED GLASS WINDOWS

[75] Inventor: Donald Butler, Costa Mesa, Calif.

[73] Assignee: Stained Glass Overlay, Inc., Mission Viejo, Calif.

[21] Appl. No.: 158,919

[22] Filed: Jun. 12, 1980

Related U.S. Application Data

[62] Division of Ser. No. 962,123, Nov. 20, 1978, abandoned.

[51] Int. Cl.[3] ..... B44F 1/06

[52] U.S. Cl. ..... 428/38; 52/311; 156/63

[58] Field of Search ..... 428/38, 430; 52/311; 156/63

[56] References Cited

U.S. PATENT DOCUMENTS

| | | | |
|---|---|---|---|
| 667,444 | 2/1901 | Kyle | 428/38 |
| 696,392 | 3/1902 | Corner | 428/38 |
| 744,209 | 11/1903 | Kyle | 428/38 |
| 1,524,998 | 2/1925 | Russell | 156/63 |
| 1,800,763 | 4/1931 | Warga | 428/38 X |
| 2,095,402 | 10/1937 | Stark, Jr. | 428/38 |
| 2,190,627 | 2/1940 | Payberg | 428/38 X |
| 2,961,365 | 11/1960 | Sroog | 428/285 |
| 3,256,133 | 6/1966 | Wright et al. | 428/480 X |
| 3,312,563 | 4/1967 | Rusch | 428/483 X |
| 3,420,728 | 1/1969 | Haverstock | 428/38 |
| 3,713,958 | 1/1973 | McCracken | 428/38 |
| 3,815,263 | 6/1974 | Oberwager | 428/38 X |

OTHER PUBLICATIONS

How to Make Leaded Stain-Glass (48 pages), Copyright 1971 Beagle Manufacturing Co., Inc. El Monte, Calif., 91731, Litho USA.

Glaze-Glass Craft (6 pages) Beagle Manufacturing Co., Inc. 4377 North Baldwin Ave., El Monte, Calif. 91731.

Indian Summer Leaves—2 pages.

*Primary Examiner*—Henry F. Epstein

*Attorney, Agent, or Firm*—Fischer, Tachner & Strauss

[57] ABSTRACT

A method of simulating stained and leaded glass windows including bonding lead strips to a pane of glass or plastic to form design segments, and bonding coatings to the pane coincidental with the design segments to simulate colored glass and the simulated stained and leaded glass structure produced by the method.

12 Claims, 3 Drawing Figures

SIMULATED STAINED AND LEADED GLASS WINDOWS

This is a division of application Ser. No. 962,123, filed Nov. 20, 1978, now abandoned.

BACKGROUND OF THE INVENTION a. Field of the Invention

This invention relates generally to decorative windows and, more specifically, to decorative windows simulating the appearance of stained and leaded glass.

b. Description of the Prior Art

Stained and leaded glass has enjoyed a popularity for generations. Its inherent beauty and durability have graced the ancient cathedrals and buildings of state and, recently, has been the object of renewed interest for use in commercial and residential structures.

As the original stained and leaded glass techniques involved time consuming and arduous processes, modern and simpler methods have been developed. However, the modern processes for producing "authentic" stained and leaded glass continue to require the cutting of individual segments of colored glass and the joining of such segments with grooved lead strips or came. The extensive use of came, especially in a window embodying an intricate design, results in a loss of structural integrity since the lead adds to the weight of the window and coincidentally makes the window pliable along each lead line. Thus "authentic" stained and leaded glass windows which are of moderate to large size must be externally supported, for example by metallic bars, which detracts from the beauty of the design. In addition, "authentic" stained and leaded glass is unsuitable for curved surfaces or environments which are exposed to extreme or frequent vibrations. Also, even the modern method of producing "authentic" stained and leaded glass is labor intensive and, thus, economically prohibitive for many applications, especially where large windows are desired.

In the construction of new buildings in particular, "authentic" stained and leaded glass is generally unsuitable for many windows as building codes frequently specify single pane tempered or plate glass for entry ways and windows installed in bearing walls. The segmented nature of the "authentic" windows is, thus, clearly prohibited. Moreover, tempered glass cannot be scored and broken in the manner required by such traditional techniques.

As a result of the above disadvantages, many attempts have been made to simulate stained and leaded glass. Such prior art techniques variously involve coloring clear glass panes using paints, varnishes, colored gelatin, acetate, cellophane, and tissue paper and involve simulated lead joints of adhesive-backed lead strips or lead emulsions brushed or squeezed onto the glass. However, no known simulated stained and leaded glass technique results in the permanence and beauty of "authentic" stained and leaded glass while producing a structurally sound window suitable for use in large sizes, in curved windows, and in locations exposed to vibrations.

SUMMARY OF THE INVENTION

In order to provide simulated stained and leaded glass windows embodying permanence and structural integrity, there is described a system wherein lead strips are coated with adhesive and applied to a clear glass or plastic pane to define closed areas of a selected pattern, and painted or pigmented polyester film is coated with adhesive and applied to the opposite side of the glass or plastic pane. Additionally, lead strips may then be applied to the second side of the pane coinciding with the original lead strips.

The lead strips, do not separate the pane into small segments and, therefore add rather than detract from structural integrity of the pane. The polyester film, after being applied with adhesive, becomes permanently affixed to the pane and, coincidentally, becomes a bonding media which minimizes shattering should the pane be broken.

BRIEF DESCRIPTION OF THE DRAWING

The invention may be more fully appreciated from the following detailed description of the preferred embodiment thereof taken in conjunction with the appended drawings wherein.

DETAILED DESCRIPTION OF THE DRAWINGS

Figure 1:
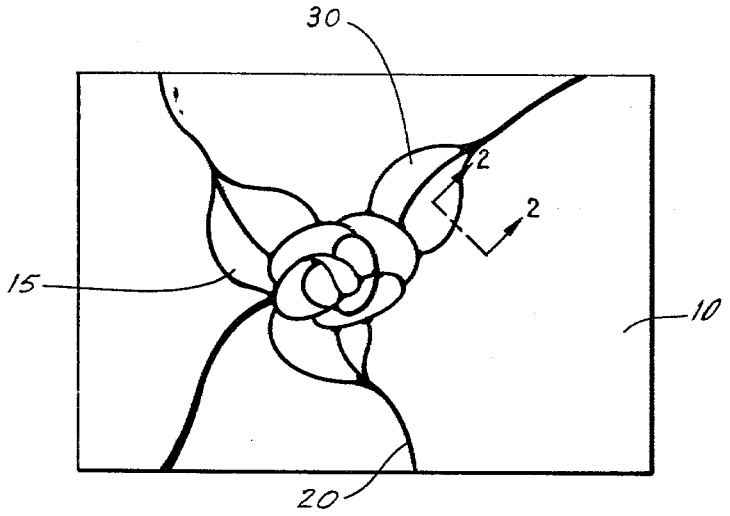
FIG. 1 is a plan view of a window pane embodying this invention.
Figure 2:
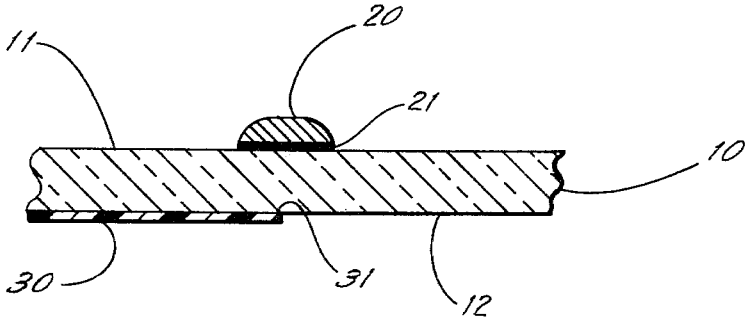
FIG. 2 is a sectional view taken along line 2—2 of FIG. 1.

Referring now to FIGS. 1 and 2, a glass or plastic pane 10 may be seen to be divided into a plurality of closed segments 15 by lead strips 20. The pane 10 may be any smooth transparent surface and may be in any accessible location. Permissible materials of construction of the pane 10 include tempered, double strength, plate and frosted glass. In applying the techniques as taught herein, removal of the pane 10 from its mounting is unnecessary. In addition, while a flat planar surface is shown, the pane 10 may incorporate curved surfaces as found, for example, in vehicle windows and domed skylights. For illustrative purposes, each pane 10 will be assumed to incorporate a front side 11 and a reverse side 12.

The lead strips 20 are preferably extruded from pure lead or, alternatively, extruded using a lead alloy containing approximately 2% antimony, which alloy has a comparatively slower rate of oxidation. The lead or lead alloy strips 20 may be of various widths depending upon the desired esthetic effect and are preferably approximately 0.022 inch thick with one flat side.

Each segment 15 of the design may be variously colored by the addition of a painted or tinted coating 30 applied to the reverse side 12 of the pane 10 with the edges of the coating 30 coinciding with the lead strips 20 defining the segment 15.

The coating 30 is preferably formed of a polyester sheet approximately one mil thick sold commercially under the trademark Mylar. Interposed between the pane 10 and the coating 30 is an adhesive 31 which greatly adds to the permanence of the simulated stained and leaded glass window and, in addition, imparts shatter proof characteristics to the pane 10.

Figure 3:
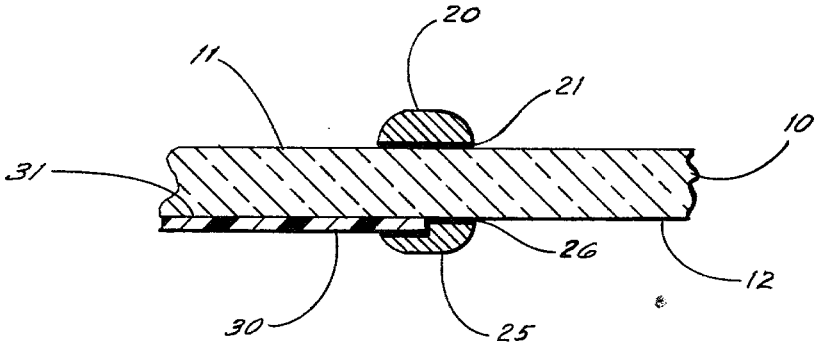
FIG. 3 is a sectional view similar to FIG. 2 showing an alternative embodiment.

As shown in FIG. 3, a second lead strip 25 may be applied to the reverse side 12 of the pane 10 coincidentally with the first lead strip 20. This embodiment would commonly be preferred where the pane 10 is routinely viewed from both the front 11 and reverse 12 sides.

In the assembly of a simulated stained and leaded glass window, the pane 10 is first scrupulously cleaned and a decorative design drawn directly upon the pane 10. Alternatively, a design drawn on paper may be temporarily taped to the reverse side 12 of the pane 10. Next an appropriate adhesive 21 is applied to the flat side of the first lead strips 20. The adhesive 21 is preferably either clear, silver-gray, or black depending upon the esthetic effect desired. The lead may then be stretched to remove any kinks and undesired bends and then laid upon the front side 11 of the pane 10 covering the previously drawn lines of the design. A wooden tool, not shown, having a concave contour similar to the convex exposed side of the lead strips 20 is preferably utilized to urge the lead strips 20 firmly onto the pane 10 thus removing all entrapped air pockets and sealing the edges of the strips 20. Excess adhesive 21 may be removed by wiping with solvent, which can also remove any oxidation from the lead strips 20.

The next step involves applying the polyester coating 30 to the opposite side 12 of the pane 10 to simulate the appearance of colored glass. A sheet of polyester coating 30 must be chosen which equals or exceeds all the dimensions of the design section 15 to be colored. Waterproof adhesive 31 is then brushed or rolled onto one side of the coating 30. Following the application of adhesive 31, a soap solution must be brushed or rolled onto the same side of the polyester coating 30. The soap solution, not shown in the drawing, neutralizes the adhesive 31 and allows the coating 30 to be positioned upon the reverse side 12 of the pane 10 where it may be slid into position opposite the appropriate design segment 15 where the coating 30 is then trimmed with a razor blade to match the edges of the coating 30 with the lead strips 20 of the design segment 15. The soap solution may then be removed by pressing the coating 30 firmly against the pane 10 with a squeegee or similar tool, not shown in the drawing. Thus the adhesive 31 permanently bonds the coating 30 to the pane 10.

From the discussion, it is clear that a polyester coating 30 tinted with impregnated pigment may be used to produce the desired color for each design segment 15. In addition, the polyester coating 30 may be painted, preferably by a silk screening process, prior to being applied to the pane 10 as discussed previously. The use of silk screening allows a broad range of effects including the simulation of "opaque" or translucent stained glass. This particular effect is enhanced by the use of "frosted" polyester. A third method of producing the desired color when utilizing the techniques of this invention involves the use of pigmented adhesive 31 which again allows for a wide range of esthetic effects and colors.

For simulated stained and leaded glass windows which are to be viewed from both the front side 11 and reverse side 12, second lead strips 25 may be applied to the reverse side 12 of the pane 10 using additional adhesive 26, whereby the second lead strips may be spatially located to coincide with the first lead strips 20. The use of second lead strips 25 is particularly desirable when the adhesive 21 used to secure the first lead strips 20 is black. If the polyester coating 30 used is of the painted type, as discussed above, it is preferable to utilize a transparent polyester coating, not shown in the drawing, similarly applied and covering the first coating 30 prior to attaching the second lead strips 25 so as to assure a permanent bond for the second lead strips 25.

Using these techniques, there have been produced simulated stained and leaded glass for windows in vehicles where curvatures and vibrations make traditional stained and leaded glass techniques inapplicable. Also, large glass panes have been decorated where external supports are impractical or where building codes require a single pane as, for example, in a standard sliding glass door. It has been found that the time required to produce a simulated stained and leaded glass window utilizing the techniques as described above is a fraction of the time which would be required were the more traditional came method to be used.

It is understood that the embodiment described above is merely an example of the application of the principles of this invention. Additional embodiments may be devised by those skilled in the art without departing from the spirit or scope of the invention.

I claim:

1. A process for producing a simulated stained and leaded glass structure from a pane of glass or plastic having a front side and a reverse side comprising the steps of:

a. adhering extruded lead strips to the front side of the pane thereby forming closed design segments thereof.

b. providing at least one sheet of polyester material with adhesive on one side thereof;

c. covering the adhesive on said one side of said polyester material with a lubricant whereby the adhesive is temporarily rendered inactive;

d. positioning said one side of said sheet to said pane correspondingly coinciding with the closed design segments formed on said front side thereof;

e. trimming the edges of said sheet to correspond to said closed design segments; and, f. removing said lubricant by squeezing said sheets against the pane whereby said sheet is permanently bonded to said pane.

2. The process recited in claim 1 wherein,
said lead strips are adhered to said pane by an adhesive.

3. The process recited in claim 2 wherein,
said lubricant is selected to be inert relative to the adhesive used with said lead strips.

4. The process recited in claim 3 wherein,
said lubricant is formed of a soapy solution.

5. The process recited in claim 1 wherein,
said sheet of polyester material is positioned adjacent said reverse side of said pane.

6. The process recited in claim 1 wherein,
said pane is formed of substantially clear material.

7. The process recited in claim 1 wherein,
said pane is substantially smooth on both the front and reverse sides.

8. The process recited in claim 1 including the step of,
applying an adhesive to one side of said polyester material.

9. The process recited in claim 1 including the step of,
adhering extruded lead strips to the reverse side of said pane in coincidence with the lead strips previously adhered to said front side of said pane.

10. The process recited in claim 1 wherein,
said polyester material exhibits a predetermined color.

11. The process recited in claim 10 wherein,
said sheet is permanently bonded to said pane in order to impart additional strength thereto.

12. A simulated stained and leaded glass structure produced by the process of;

providing a panel of glass or plastic having two major parallel surfaces;

adhering lead strips to one surface of said panel thereby forming closed design segments thereon;

providing at least one sheet of polyester material having adhesive on one side thereof;

covering the adhesive on said one side of said sheet of polyester material with a lubricant whereby the adhesive is temporarily rendered inactive;

positioning said one side of said sheet to said panel to coincide with the closed design segments on said one surface;

trimming the edges of said sheet to correspond to the closed design segments; and removing said lubricant by squeezing said sheets against said panel whereby said sheet is permanently bonded to said panel.

* * * * *